US008006379B2

(12) United States Patent
Susa et al.

(10) Patent No.: US 8,006,379 B2
(45) Date of Patent: Aug. 30, 2011

(54) FIXED SCROLL POSITIONING APPARATUS AND FIXED SCROLL POSITIONING METHOD

(75) Inventors: Toshihiro Susa, Osaka (JP); Takayuki Takahashi, Osaka (JP); Takashi Hirouchi, Osaka (JP); Hiroyuki Yamaji, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 1075 days.

(21) Appl. No.: 11/795,570

(22) PCT Filed: Nov. 29, 2005

(86) PCT No.: PCT/JP2005/021853

§ 371 (c)(1),
(2), (4) Date: Jul. 19, 2007

(87) PCT Pub. No.: WO2006/080137

PCT Pub. Date: Aug. 3, 2006

(65) Prior Publication Data

US 2008/0092385 A1 Apr. 24, 2008

(30) Foreign Application Priority Data

Jan. 31, 2005 (JP) ..... 2005-023073

(51) Int. Cl.
*B23P 15/00* (2006.01)

(52) U.S. Cl. ..... 29/888.022; 29/888.02; 29/890.035

(58) Field of Classification Search ..... 29/888.022, 29/888.02, 406, 407.01; 418/55.1, 55.5
See application file for complete search history.

(56) References Cited

U.S. PATENT DOCUMENTS

| | | | | |
|---|---|---|---|---|
| 4,649,611 | A | 3/1987 | Ikeda et al. | |
| 2002/0062560 | A1 * | 5/2002 | Takeda et al. | 29/888.022 |
| 2002/0098100 | A1 * | 7/2002 | Mori et al. | 418/55.2 |
| 2003/0133818 | A1 * | 7/2003 | Quesada et al. | 418/55.1 |

FOREIGN PATENT DOCUMENTS

| | | | |
|---|---|---|---|
| JP | 63-295886 | A | 12/1988 |
| JP | 2-221693 | A | 9/1990 |
| JP | 3-267590 | A | 11/1991 |
| JP | 5-24356 | B2 | 4/1993 |
| JP | 9-250476 | A | 9/1997 |
| JP | 2002-81385 | A | 3/2002 |
| KR | 101989/000050 | B1 | 6/1989 |

* cited by examiner

*Primary Examiner* — David P Bryant
*Assistant Examiner* — Moshe Wilensky
(74) *Attorney, Agent, or Firm* — Birch, Stewart, Kolasch & Birch, LLP

(57) ABSTRACT

In a positioning apparatus, a fixed scroll engaged with a movable scroll is pressed against a housing member, and then, is stirred to an appropriate position by applying impact force to the fixed scroll in this state. Thus, the stirring of the fixed scroll terminates in the state that the fixed scroll is pressed against the housing member.

6 Claims, 9 Drawing Sheets

FIXED SCROLL POSITIONING APPARATUS AND FIXED SCROLL POSITIONING METHOD

TECHNICAL FIELD

The present invention relates to a method and an apparatus for positioning a fixed scroll in assembling a scroll fluid machinery.

BACKGROUND ART

Conventionally, scroll fluid machineries are widely used in compressors provided for compressing refrigerant in refrigeration circuits such as air conditioners. In a scroll fluid machinery, a fixed side volute rap and a movable side volute rap are provided at a fixed scroll and a movable scroll, respectively, so as to engage with each other to form a fluid chamber. In the scroll fluid machinery, the movable scroll revolves to change the volume of the fluid chamber. For example, in a scroll compressor, the volume of the fluid chamber in a closed state decreases, thereby compressing the fluid in the fluid chamber.

In this way, the movable scroll revolves with its rap engaging with the rap of the fixed scroll in the scroll fluid machinery. In order to move the movable scroll smoothly, the fixed scroll must be arranged accurately at the position where the rap of the revolving movable scroll evades hard contact with the rap of the fixed scroll. For this reason, the fixed scroll must be positioned accurately in assembling the scroll fluid machinery. Methods and apparatuses for positioning the fixed scroll have been disclosed in Patent Document 1 and Patent Document 2, for example.

Specifically, in the positioning method disclosed in Patent Document 1, an assembly body is prepared first by assembling a movable scroll, a crank shaft engaged therewith, and a bearing for the crank shaft. Next, a fixed scroll is engaged with the movable scroll of the assembly body, and then, the crank shaft in this state is rotated by a motor. Then, torque variation necessary for rotating the crank shaft is detected, and a contacting degree and a contact direction of the fixed scroll to the movable scroll are calculated on the basis of the detected torque variation. Subsequently, a distance by and direction in which the fixed scroll is to be moved are lead out according to the contacting degree and the contact direction of the fixed scroll to the movable scroll, and then, the fixed scroll is moved on the basis of the lead out distance and direction by a moving tool composed of a motor.

Referring to the positioning method disclosed in Patent Document 2, an assembly body is prepared first by assembling a movable scroll, a crank shaft engaged therewith, and a bearing for the crank shaft. Next, a fixed scroll is engaged with the movable scroll of the assembly body, and then, the crank shaft in this state is rotated 90° by 90° by a motor. Wherein, the fixed scroll is moved until the rap of the movable scroll and the rap of the fixed scroll are in contact with each other at each rotation angle 0°, 29°, 180°, 270° of the crank shaft. Then, the position where the fixed scroll is to be arranged is calculated on the basis of the moving amount of the fixed scroll in each rotation angle of the crank shaft, and then, the fixed scroll is moved to the calculated position by a pressing cylinder.

Patent Document 1: Japanese Patent Publication No. 05-024356A

Patent Document 2: Japanese Patent Application Laid Open Publication No. 2002-081385A

SUMMARY OF THE INVENTION

Problems that the Invention is to Solve

The fixed scroll is moved by the moving tool composed of the motor in the positioning apparatus disclosed in Patent Document 1 and is moved by the pressing cylinder of the fixed scroll in Patent Document 2. Accordingly, friction force working on the contact face between the fixed scroll and a housing member that supports the movable scroll makes it difficult to finely adjust the position of the fixed scroll. In detail, force generated by a motor or a cylinder, which changes continuously, is applied to the fixed scroll, and therefore, the fixed scroll is displaced largely at the time when the generated force exceeds the friction force. This makes it difficult to accurately move the fixed scroll by a necessary distance.

Under the circumstances, in the conventional positioning apparatuses of Patent Document 1 and Patent Document 2, the fixed scroll and the housing member are fixed with a slight distance left from each other so that the friction force does not work during the time when the fixed scroll is moved. For this reason, when the fixed scroll is made in contact with the housing member after the moving of the fixed scroll terminates, the fixed scroll may be displaced from the position where the fixed scroll has been moved.

The present invention has been made in view of the above problems and has its object of positioning a fixed scroll with high accuracy in assembling a scroll fluid machinery.

Means of Solving the Problems

The first invention directs to an apparatus, which is used in an assembling process of a scroll fluid machinery (10), for positioning a fixed scroll (34) on the basis of a positional relationship between a rap (35) of the fixed scroll (34) and a rap (32) of a movable scroll (31). Wherein, the apparatus includes: a fixing member (63) for fixing an assembly body (11) of an integrated combination of the movable scroll (31), a crank shaft (20) engaged with the movable scroll (31), and a housing member (36) composing a bearing of the crank shaft (20); a pressing mechanism (56) for pressing the fixed scroll (34) engaged with the movable scroll (31) against the housing member (36); determining means (80) for determining a stirring distance and a stirring direction of the fixed scroll (34); and a stirring mechanism (75) for stirring the fixed scroll (34) according to the stirring distance an the stirring direction which are determined by the determining means (80) by applying impact force to the fixed scroll (34) being pressed against the housing member (36).

Referring to the second invention, in the first invention, the determining means (80) determines the stirring distance and the stirring direction of the fixed scroll (34) so that the rap (35) of the fixed scroll (34) is out of contact with the rap (32) of the movable scroll (31) regardless of the position of the movable scroll (31).

Referring to the third invention, in the first invention or the second invention, the stirring mechanism (75) includes a plurality of striking units (70) for applying the impact force to the fixed scroll (34) by striking, and the striking units (70) in the stirring mechanism (75) are different from each other in striking direction.

Referring to the fourth invention, in the first invention or the second invention, there is provided a guide (41) for inhibiting the fixed scroll (34) from rotating while allowing the fixed scroll (34) to stir in parallel to an X axis direction or a Y axis direction which intersect at a right angle with each other.

Referring to the fifth invention, in the fourth invention, the X axis direction and the Y axis direction in which the guide (41) of the pressing mechanism (56) allows the fixed scroll (34) to stir agree with directions of the impact force that the stirring mechanism (53) applies to the fixed scroll (34).

Referring to the sixth invention, in the fifth invention, the stirring mechanism (75) includes four striking units (70) for applying the impact force to the fixed scroll (34) by striking, and two of the four striking units (75) confront each other on an axis parallel to the X axis while the other two striking units (75) confront each other on an axis parallel to the Y axis.

Referring to the seventh invention, in the third invention or the sixth invention, the striking units (70) includes a piezoelectric element (72) and applies striking by extending the piezoelectric element (73).

The eighth invention directs to a method for positioning a fixed scroll (34), in a process of assembling a scroll fluid machinery (10), on the basis of a positional relationship between a rap (35) of the fixed scroll (34) and a rap (32) of a movable scroll (31). Wherein the method includes: a first step of fixing an assembly body (11) of an integrated combination of the movable scroll (31), a crank shaft (20) engaged with the movable scroll (34), and a housing member (36) composing a bearing of the crank shaft (20) and engaging the fixed scroll (34) with the movable scroll (31); a second step of pressing the fixed scroll (34) engaged with the movable scroll (34) in the first step against the housing member (36); and a third step of adjusting the position of the fixed scroll (34) by stirring by applying impact force to the fixed scroll (34) being pressed against the housing member (36).

—Operation—

In the first invention, the pressing mechanism (56) presses the fixed scroll (34) against the housing member (36), so that the friction force works on the contact face between the fixed scroll (34) and the housing member (36) in moving the fixed scroll (34). Therefore, impact force (in other words, instant striking force) is applied to the fixed scroll (34) to move the fixed scroll (34) by the stirring mechanism (75). When the impact force is applied to the fixed scroll (34), the impact force, of which peak value is large, exceeds the friction force in a static state to cause the fixed scroll (34) to stir. However, the impact force works instantly, resulting in immediate stop of the fixed scroll (34) by the friction force in the stirring. During the time therebetween, the fixed scroll (34) stirs by a slight distance. In the positioning apparatus (40) in this invention, the fixed scroll (34) is stirred little by little in this way for adjusting the position of the fixed scroll (34). When the fixed scroll (34) is stirred in this way, the stirring of the fixed scroll (34) terminates in the sate that the fixed scroll (34) is pressed against the housing member (36). Then, the fixed scroll (34) in this state is fixed to the housing member (36) by means of a bolt or the like, so that the fixed scroll (34) is not displaced from the position at the time when the stirring terminates.

In the second invention, the position of the fixed scroll (34) is determined so that the rap (35) of the fixed scroll (34) is out of contact with the rap of the movable scroll (31) even in revolution of the movable scroll (31).

In the third invention, the stirring mechanism (75) includes the plurality of striking units (70) of which striking directions are different from each other. The stirring mechanism (75) uses any of the striking units (70) according to the direction in which the fixed scroll (34) is to be stirred for stirring the fixed scroll (34).

In the fourth invention, the guide (41) allows the fixed scroll (34) to stir in parallel to the X axis direction or the Y axis direction, which intersect at a right angle with each other, and inhibits the fixed scroll (34) from rotating. Hence, the fixed scroll (34) that receives the impact force from the stirring mechanism (75) stirs without rotating.

In the fifth invention, the impact force in the X axis direction or the Y axis direction, which intersect at a right angle with each other, is applied to the fixed scroll (34) with the fixed scroll (34) inhibited from rotating. The fixed scroll (34) stirs in the X axis direction when it receives impact force in the X axis direction while it stirs in the Y axis direction when it receives impact force in the Y axis direction.

In the sixth invention, two striking units (70) are arranged on the axis parallel to the X axis so as to confront each other on the respective sides of the fixed scroll (34) while the other two striking units (70) are arranged on the axis parallel to the Y axis so as to confront each other on the respective sides of the fixed scroll (34).

In the seventh invention, when steep voltage is applied to the piezoelectric element (73) with a corresponding striking units (70) being in contact with the fixed scroll (34), the piezoelectric element (73) instantly extends to allow the corresponding striking unit (70) to apply the impact force to the fixed scroll (34).

In the eighth invention, the fixed scroll (34) is pressed in the second step against the housing composing the assembly body (11) fixed in the first step, and the position of the fixed scroll (34) in this state is adjusted in the third step. In the third step, the impact force is applied to the fixed scroll (34) to stir the fixed scroll (34). Accordingly, in this positioning method for the fixed scroll (34), the fixed scroll (34) is positioned in the state that the fixed scroll (34) is pressed against the housing member (36).

Effects of the Invention

In the present invention, the impact force is applied to the fixed scroll (34) being pressed against the housing member (36) to stir the fixed scroll (34). The stirring of the fixed scroll (34) terminates in the state that the fixed scroll (34) is pressed against the housing (36). Accordingly, when the fixed scroll (34) in this state is fixed to the housing (36) by means of a bolt or the like, the fixed scroll (34) can be fixed at a predetermined position accurately. Hence, the fixed scroll (34) can be positioned with high accuracy in assembling the scroll fluid machinery (10).

In the fourth invention, the fixed scroll (34) is stirred without rotating. If the fixed scroll (34) would rotate in an unintentional direction, the distance between the rap (35) of the fixed scroll (34) and the rap (32) of the movable scroll (31) may be controlled less accurately. In contrast, according to this invention, the guide (41) inhibits the fixed scroll (34) from rotating, enabling accurate stirring of the fixed scroll (34) in a direction as intended. Thus, the fixed scroll (34) can be positioned with high accuracy.

In the fifth invention, the impact force in the X axis direction is applied to the fixed scroll (34) for stirring the fixed scroll (34) in the X axis direction while the impact force in the Y axis direction is applied to the fixed scroll (34) for stirring the fixed scroll (34) in the Y axis direction. Thus, the strength and the application times of the impact force in the X axis direction govern the stirring distance of the fixed scroll (34) in the X axis direction and the strength and the application times of the impact force in the Y axis direction govern the stirring distance of the fixed scroll (34) in the Y axis direction. Accordingly, adjustment of the strength and the application times of the impact force in each direction attains accurate control of the stirring distance and the stirring direction of the fixed scroll (34), resulting in accurate positioning of the fixed scroll (34).

EXPLANATION OF REFERENCE NUMERALS

Figure 1:
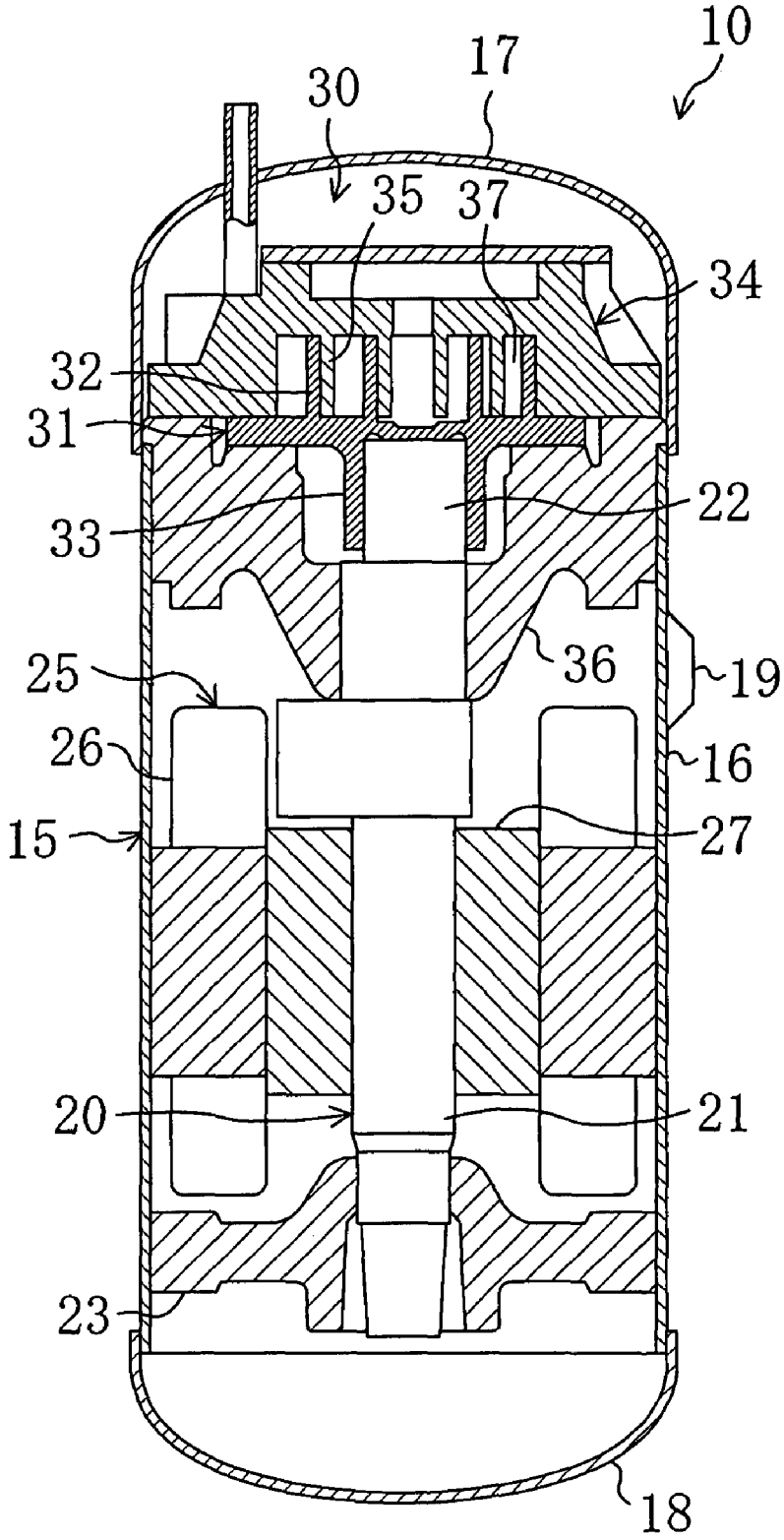
FIG. 1 is a vertical section showing a schematic construction of a scroll compressor.

10 scroll compressor (scroll fluid machinery)
11 assembly body
20 crank shaft
31 movable scroll
32 movable side rap
34 fixed scroll
35 fixed side rap
36 housing (housing member)
41 guide
56 pressing mechanism
63 clamping mechanism (fixing member)
70 striking unit
73 piezoelectric element
75 stirring mechanism
80 controller (determining means)

BEST MODE FOR CARRYING OUT THE INVENTION

The embodiments of the present invention will be described below with reference to the accompanying drawings. In the following description, the construction of a scroll compressor (10) assembled by utilizing a positioning apparatus (40) according to the present embodiment will be described first, followed by the description of the positioning apparatus (40) and a positioning method according to the present embodiment.

—Construction of Scroll Compressor—

As shown in FIG. 1, the scroll compressor (10) is formed hermetically as a whole. The scroll compressor (10) includes a casing (15) in the form of a longitudinal hermetic container. The casing (15) is composed of one body member (16) having a longitudinally cylindrical shape and head members (17, 18) formed in cap shapes and respectively mounted at the upper end and the lower end of the body member (16).

In the casing (15), a lower bearing member (23), a compressor motor (25), and a compression mechanism (30) are arranged in this order from the lower side to the upper side. Also, a crank shaft (20) is provided in the casing (15) so as to extend vertically.

The crank shaft (20) includes a main shaft portion (21) and an eccentric portion (22). The main shaft portion (21) has an upper end part of which diameter is slightly large. The eccentric portion (22) is in a column shape of which diameter is smaller than that of the main shaft portion (21) and stands on the upper end face of the main shaft portion (21). The eccentric portion (22) has an axial center eccentric away from the axial center of the main shaft portion (21).

The lower bearing member (23) is fixed at the vicinity of the lower end of the body member (16) of the casing (15). A sleeve bearing is formed at the central part of the lower bearing member (23) for rotatably supporting the lower end of the main shaft portion (21).

A generally-called brushless DC motor is used as the compressor motor (25). The compressor motor (25) includes a stator (26) and a rotor (27) to compose a drive motor. The stator (26) is fixed to the body member (16) of the casing (15). The stator (26) is connected electrically to a power supply terminal (19) mounted at the body member (16) of the casing (15). On the other hand, the rotor (27) is arranged inside the stator (26) and is fixed to the main shaft portion (21) of the crank shaft (20).

The compression mechanism (30) includes a movable scroll (31), a fixed scroll (34), and a housing (36) as a housing member (36).

The housing (36) is in a comparatively thick disk shape of which central part is recessed, and is joined at the outer peripheral part thereof to the upper end of the body member (16). The main shaft portion (21) of the crank shaft (20) is inserted in the central part of the housing (36). The housing (36) composes a bearing for rotatably supporting the main shaft portion (21) of the crank shaft (20).

The movable scroll (31) includes a movable side rap (32) in the form of volute wall standing on the front face (the upper face in FIG. 1) thereof and a cylindrical protruding portion (33) protruding from the back face (the lower face in FIG. 1) thereof. The movable scroll (31) is mounted on the upper face of the housing (36) through an Oldham ring (not shown). The eccentric portion (22) of the crank shaft (20) is inserted in the protruding portion (33) of the movable scroll (31). Namely, the movable scroll (31) is engaged with the crank shaft (20).

The fixed scroll (34) is formed in a comparatively thick disc shape. A fixed side rap (35) in the form of a volute wall is provided at the central part of the fixed scroll (34). The fixed side rap (35) is formed by scraping the fixed scroll (34) from the lower face thereof.

Figure 2:
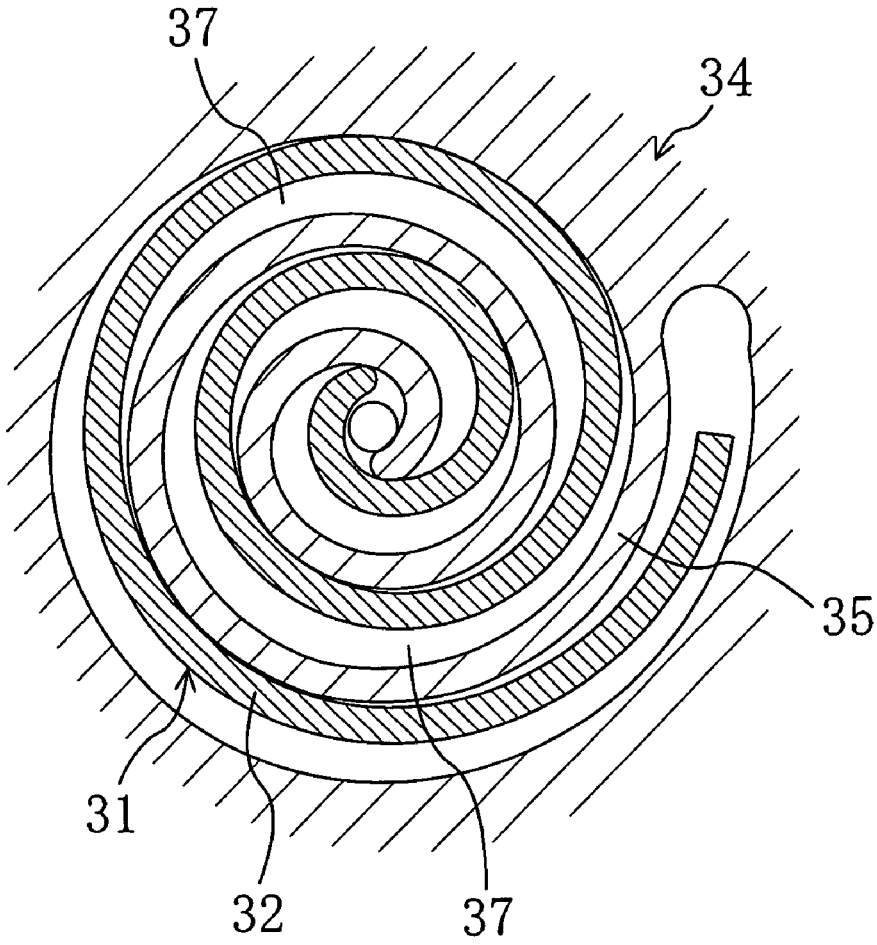
FIG. 2 is a transverse section showing a main part of the scroll compressor.

As shown in FIG. 2, in the compression mechanism (30), the fixed side rap (35) of the fixed scroll (34) and the movable side rap (32) of the movable scroll (31) engage with each other. The engagement of the fixed side rap (35) and the movable side rap (32) forms a plurality of compression chambers (37).

—Positioning Apparatus for Fixed Scroll (34)—

The positioning apparatus (40) in the present embodiment is used for positioning the fixed scroll (34) in a process of assembling the scroll compressor (10). Specifically, the positioning apparatus (40) regulates the positional relationship between the fixed scroll (34) and the movable scroll (31) by adjusting the position of the fixed scroll (34) in mounting the fixed scroll (34) to an assembly body (11) formed in the course of assembling the scroll compressor (10).

The assembly body (11) is an integrated combination of the body member (16), the housing (36), the compressor motor (25), the lower bearing member (23), the crank shaft (20), and the movable scroll (31). In the assembly body (11), the housing (36), the compressor motor (25), and the lower bearing member (23) are fixed to the body member (16) and the movable scroll (31) is mounted on the housing (36) with the crank shaft (20) engaged therewith. Also, in the assembly body (11), the stator (26) of the compressor motor (25) is connected to the power supply terminal (19) electrically.

Figure 3:
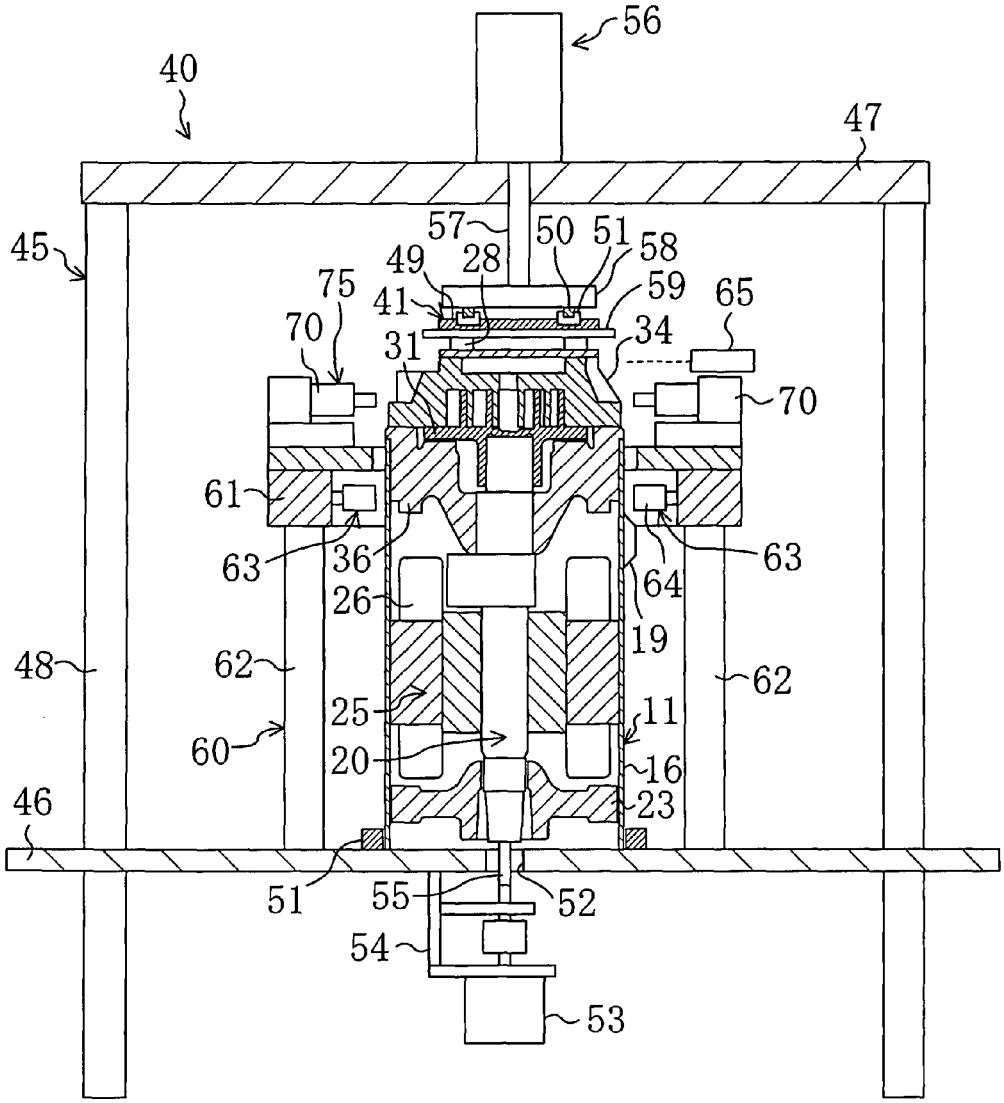
FIG. 3 is a front view showing a schematic construction of a positioning apparatus according to an embodiment.

The construction of the aforementioned positioning apparatus (40) will be described with reference to FIG. 3. The positioning apparatus (40) includes a first frame body (45) and a second frame body (60).

The first frame body (45) includes one mount plate (46), one upper plate (47), and four pole members (48). The mount plate (46) is in the rectangular shape and is arranged substantially horizontally. The pole members (48) stand at the respective corners of the mount plate (46). The pole members (48) pass through the mount plate (46) so as to protrude at the lower ends thereof downwards from the mount plate (46). The upper plate (47) is placed on the four standing pole members (48).

A cylindrical guide member (51) protrudes at the central part on the upper face of the mount plate (46). The guide member (51) is provided for guiding the body member (16) to a predetermined position in placing the assembly body (11) on the mount plate (46) and has an inner diameter slightly larger than the outer diameter of the body member (16). A through hole (52) is formed at the center of the mount plate (46). The through hole (52) is a circular hole coaxial with the guide member (51) and passes through the mount plate (46).

A rotary encoder (53) is mounted under the mount plate (46) by means of a bracket (54). The rotary encoder (53) is arranged below the through hole (52) and has a rotary shaft extending upward towards the through hole (52). A coupling (55) is mounted to the rotary shaft of the rotary encoder (53). The coupling (55) passes through the through hole (52) so as to protrude from the upper face of the mount plate (46) and is detachably fitted at the tip end thereof to the lower end of the crank shaft (20) of the scroll compressor (10).

A pressing mechanism (56) for pressing the fixed scroll (34) downwards is mounted to the upper plate (47). The pressing mechanism (56) includes a rod (57) extending downwards and is arranged at the substantial center of the upper plate (47). A pressing member (58) having a cross section larger than the rod (57) is mounted at the tip end of the rod (57). A guide (41) described later is mounted on the lower face of the pressing member (58). The pressing mechanism (56) is so composed that the rod (57) is fed using a feed screw mechanism or the like to move the pressing member (58) and the guide (41) downwards, thereby applying pressing force to the fixed scroll (34).

Figure 4:
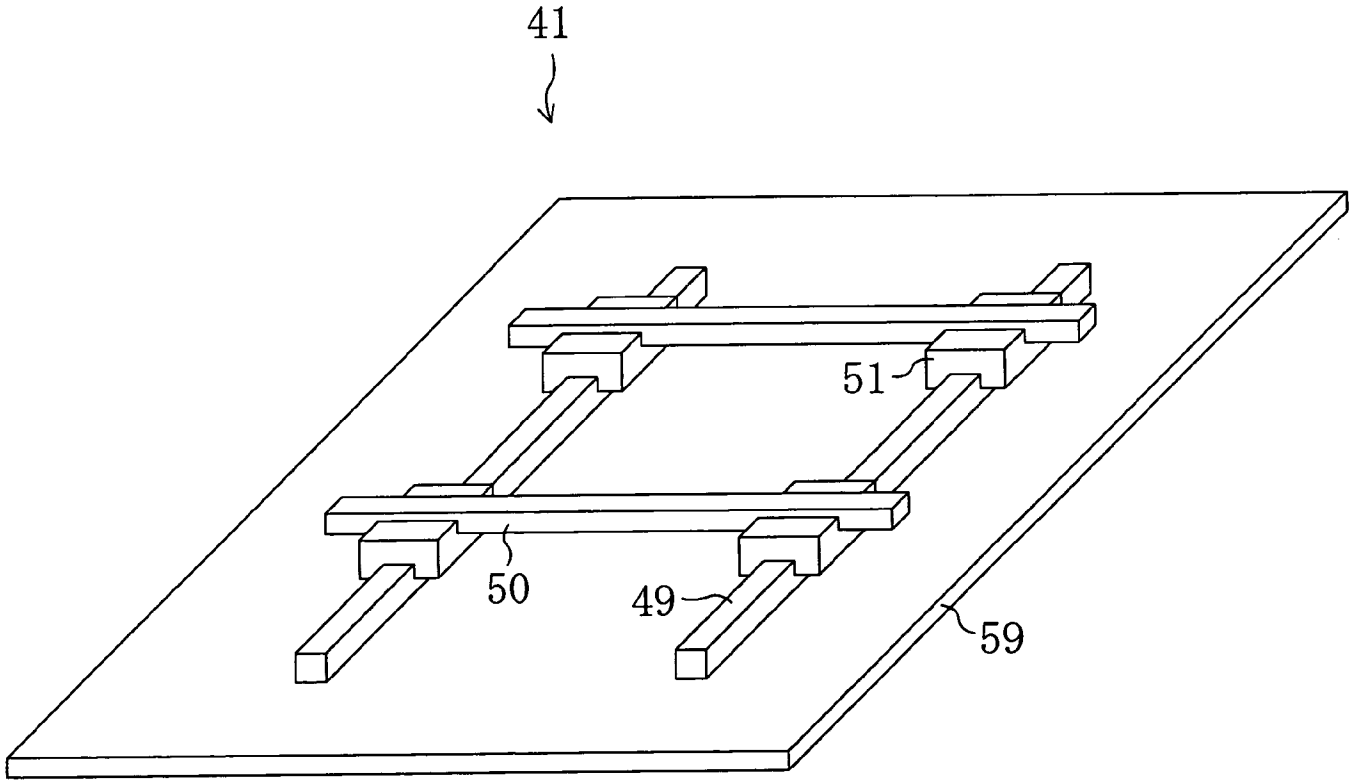
FIG. 4 is a perspective view showing a guide of a pressing mechanism according to the embodiment.

The construction of the guide (41) will be described next with reference to FIG. 4. The guide (41) includes a base plate (59), an X axis rail (49) and a Y axis rail (50) intersecting at a right angle with each other, stirring direction restricting members (51) engaging with the X axis rail (49) and the Y axis rail (50), and a shoe (28) provided at the lower face of the base plate (59). The X axis rail (49) is composed of two rail members having the same length. These two rail members are fixed in parallel to each other at a predetermined distance left apart on the upper face of the base plate (59). The Y axis rail (50) is composed of two rail members having the same length. These two rail members are fixed in parallel to each other at a predetermined distance left apart below the lower face the pressing member (58). The shoe (28) is in a rail shape and is fixed on the lower face of the base plate (59). The shoe (28) inhibits the fixed scroll (34) from sliding relative to the guide (41) when the fixed scroll (34) is stirred with the guide (41) applying the pressing force to the fixed scroll (34). At the contact face between the shoe (28) and the fixed scroll (34), friction force is generated which is larger than that generated at the contact face between the fixed scroll (34) and the housing (36).

The stirring direction restricting members (51) are arranged at the respective parts where the X axis rail (49) and the Y axis rail (50) intersect with each other. Namely, the guide (41) includes four stirring direction restricting members (51) in total. Each stirring direction restricting member (51), which is substantially in a cuboid shape, has a groove in the lower face portion to which a rail member of the X axis rail (49) is fitted and a groove in the upper face portion to which a rail member of the Y axis rail (50) is fitted. A plurality of ball members (not shown) are embedded in the grooves in the X axis direction and the Y axis direction of each stirring direction restricting member (51). Each stirring direction restricting member (51) is in contact with a rail member of the X axis rail (49) and a rail member of the Y axis rail (50) through the plural ball members so as to serve as rolling guides that move straight along the corresponding rails. Whereby, the guide (41) allows the fixed scroll (34) to stir in parallel in the X axis direction or the Y axis direction, which intersect at a right angle with each other, while inhibiting the fixed scroll (34) from rotating in the state that the pressing force is applied to the fixed scroll (34).

The second frame body (60) includes one frame member (61) and four pole members (62) and is fixed on the mount plate (46). Specifically, each pole member (62) has a length slightly shorter than the length of the body member (16) composing the assembly body (11). The four pole members (62) stand on the mount plate (46) at regular intervals left around the guide members (51). The frame member (61) is in the form of a circular or rectangular frame and is placed on the four pole members (62). The frame member (61) is fixed to the pole members (62) so as to surround the upper part of the assembly member (11).

A clamping mechanism (63) for fixing the assembly body (11) is provided at the frame member (61). The clamping mechanism (63) composes a fixing member. The clamping mechanism (63) includes a plurality of movable clamp heads (64) protruding inward of the frame member (61). The clamping mechanism (63) clamps the assembly body (11) in such a manner that the clumping mechanism (63) pushes the outer peripheral face of the body member (16) composing the assembly body (11) so as to pinch the assembly body (11) from both sides in the radial direction of the body member (16).

One laser displacement gauge (65) and four striking units (70) are arranged on the frame member (61). The laser displacement gauge (65) irradiates a laser beam to the fixed scroll (34) to measure the displacement amount of the fixed scroll (34). Each of the striking units (70) is in a column shape and includes a head (74) having a stub at the tip end thereof. The four striking units (70) compose a stirring mechanism (75) for stirring the fixed scroll (34) by applying impact force to the fixed scroll (34). The construction of the striking units (70) will be described later.

Figure 5:
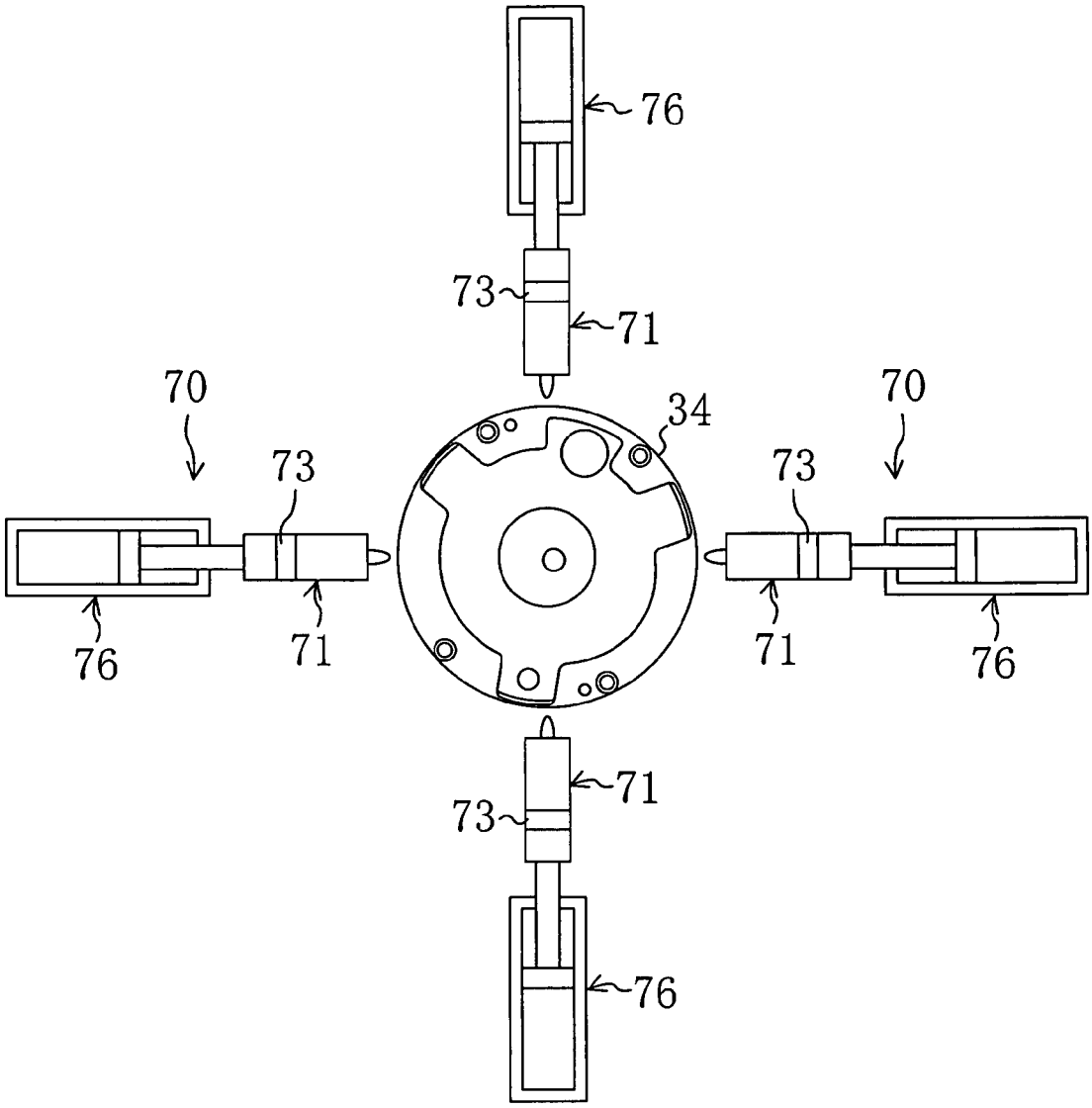
FIG. 5 is a plan view showing a main part of the positioning apparatus according to the embodiment.

As shown in FIG. 5, the four striking units (70) are arranged radially at intervals of 90° with the fixed scroll (34) on the housing (36) of the assembly body (11) as a center. Namely, two striking units (70) are arranged along a first radial direction of the fixed scroll (34) while the other two striking units (70) are arranged along a second radial direction that intersects at a right angle with the first radial direction thereof. The stub of the head (74) of each striking unit (70) confronts the fixed scroll (34). In other words, pairs of two striking units (70) arranged along one radial direction confront each other with the fixed scroll (34) interposed. The first radial direction is in parallel to the X axis direction of the guide (41). The second radial direction is in parallel to the Y axis direction of the guide (41). Namely, the X axis direction and the Y axis direction in which the guide (41) allows the fixed scroll (34) to stir agree with respective directions of the impact force that the striking units (70) apply to the fixed scroll (34). When one of the striking units (70) applies impact force in the X axis direction to the fixed scroll (34), the X axis rail (49) rolls in the grooves of the corresponding stirring direction restricting members (51) to stir the fixed scroll (34) in the X axis direction. In contrast, when one of the striking units (70) applies impact force in the Y axis direction to the fixed scroll (34), the Y axis rail (51) rolls in the grooves of the corresponding stirring direction restricting members (51) to stir the fixed scroll (34) in the Y axis direction.

Figure 6A:
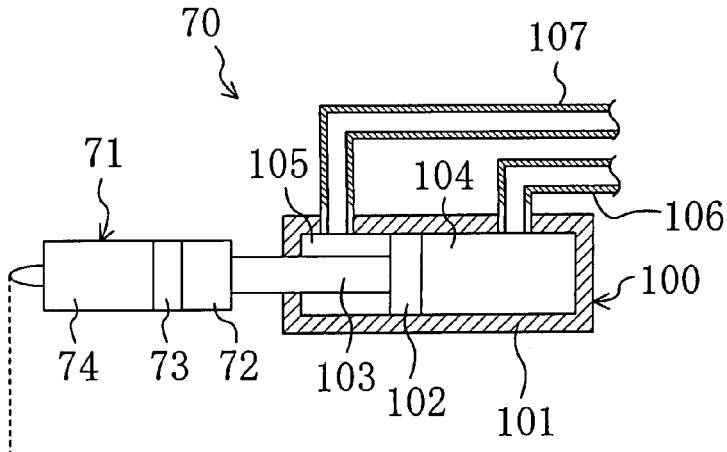
FIG. 6 is a section showing a construction of a striking unit according to the embodiment.
Figure 6B:
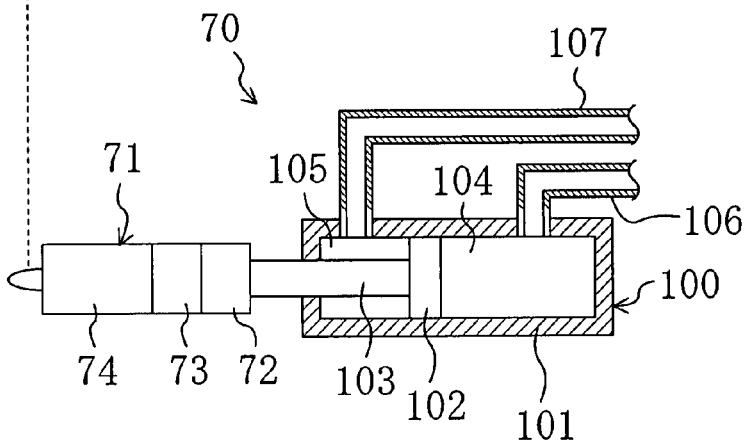

The construction of the striking units (70) will be described next with reference to FIG. 6. Each of the striking units (70) includes one main portion (71) and one air cylinder section (100). The main portion (71) and the air cylinder section (100) have outer shapes in the form of columns and are arranged coaxially.

The main portion (71) includes a base (72), a piezoelectric element (73), and a head (74) and are in a column shape as a whole. Specifically, in the main portion (71), the base (72) and the head (74), which are in column shapes, are arranged coaxially, and the piezoelectric element (73) is interposed between the base (72) and the head (74). A stub is formed at the tip end (that is, on the side opposite the piezoelectric element (73)) of the head (74). In the main portion (71), when voltage is applied to the piezoelectric element (73), the piezoelectric element (73) extends in the axial direction of the main portion (71). In association with the extension of the piezoelectric element (73), the head (74) is pushed outward (see FIG. 6(A)). When voltage application to the piezoelectric element (73) is halted, the piezoelectric element (73) returns to the original length, resulting in return of the head (74) in the original position (see FIG. 6(B)).

The air cylinder section (100) includes a cylinder (101), a piston (102), and a rod (103). The cylinder (101) is formed cylindrically to have a hollow therein. The piston (102) is inserted in the cylinder (101) so as to be movable in the axial direction of the cylinder (101). The rod (103) is arranged coaxial with the cylinder (101). The rod (103) has a base end connected to the piston (102) and a tip end extending outside the cylinder (101). The tip end of the rod (103) is joined to the end face of the base (72) of the main portion (71). The inside of the cylinder (101) is divided by the piston (102) into a first air chamber (104) and a second air chamber (105). A first air pipe (106) is connected to the first air chamber (104) on the side opposite the rod (103) while a second air pipe (107) is connected to the second air chamber (105) on the rod (103) side.

In each of the striking units (70), when air is supplied through the first air pipe (106) to the first air chamber (104) and air is discharged from the second air chamber (105) through the second air pipe (107), the piston (102) moves towards the second air chamber (105) to feed the main portion (71) towards the tip end of the striking unit (70) (leftwards in FIG. 6). In reverse, when air is supplied through the second air pipe (107) to the second air chamber (105) and air is discharged from the first air chamber (104) through the first air pipe (106), the piston (102) moves towards the first air chamber (104) to return the main portion (71) backwards to the base end side (rightwards in FIG. 6) of the striking unit (70).

Figure 7:
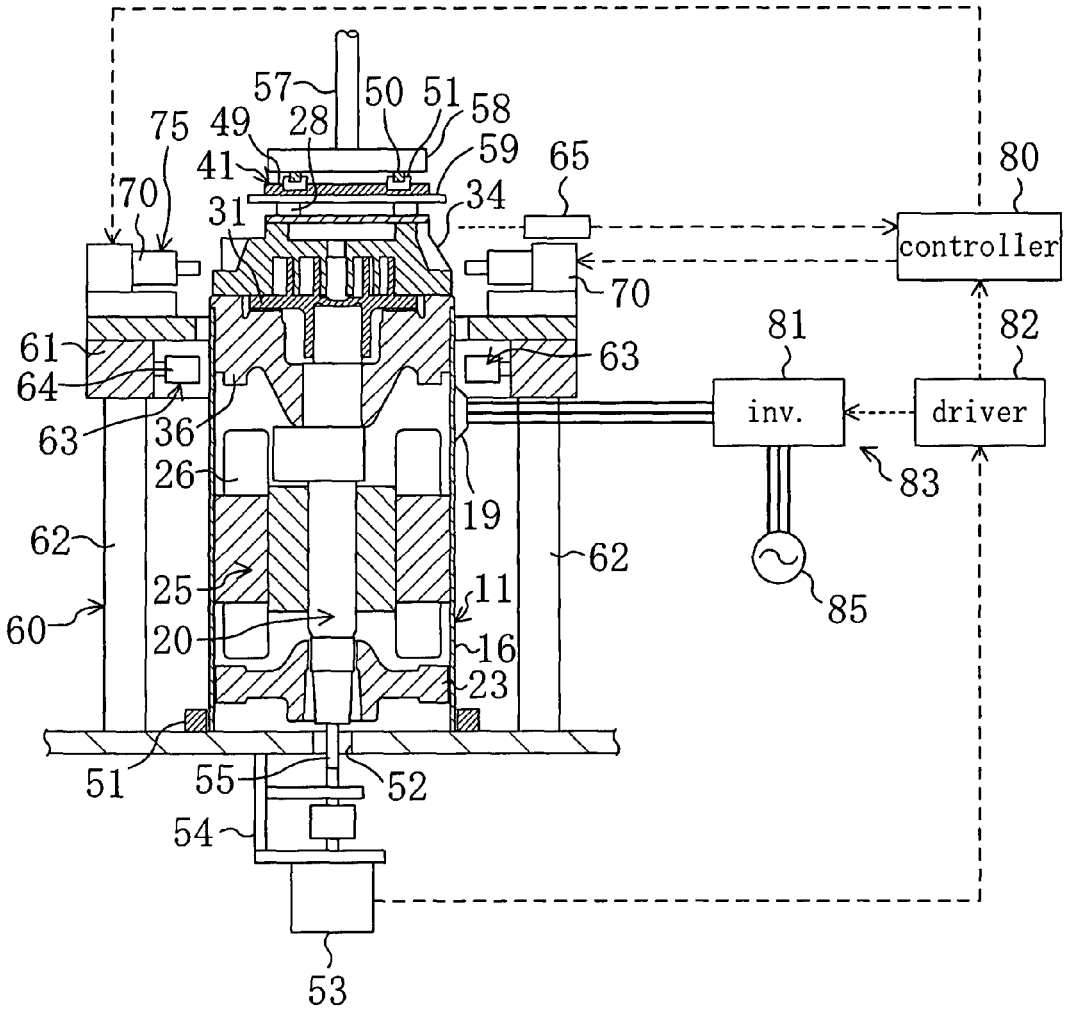
FIG. 7 is a schematic view of the positioning apparatus according to the embodiment.

As shown in FIG. 7, the positioning apparatus (40) is provided with an inverter (81), a driver (82) of the inverter (81), and a controller (80). The inverter (81) and the driver (82) composes power supply means (83).

The inverter (81) is connected at an input side thereof to a utility power source (85) and is connected at an output side thereof to the power supply terminal (19) of the assembly body (11). The driver (82) receives an output signal of the rotary encoder (53). The driver (82) calculates a rotation angle and an angular velocity of the crank shaft (20) on the basis of the output signal of the rotary encoder (53) and determines an instruction value relating to an output current value and an output frequency of the inverter (81) according to the calculation result. Then, the driver (82) outputs an instruction relating to switching timing and the like to the inverter (81) so that the output of the inverter (81) corresponds to the instruction value. The inverter (81) operates according to the instruction from the driver (82) and supplies an alternating current to the compressor motor (25) of the assembly body (11).

The controller (80) composes determining means. The controller (80) receives from the driver (82) the instruction value relating to the output current of the inverter (81) and information on the rotation angle of the crank shaft (20). The controller (80) monitors change in rotational toque of the compressor motor (25) with the use of the input value and the like from the driver (82) during rotation of the crank shaft (20). Further, the controller (80) determines a direction in and a distance by which the fixed scroll (34) is to be stirred on the basis of the change in rotational torque of the compressor motor (25), and then, controls the striking units (70) composing the stirring mechanism (85) according to the determination.

Further, though not shown, the positioning apparatus (40) includes a laser displacement gauge for measuring the phase of the crank shaft (20). The laser displacement gauge for phase measurement calculates the phase of the crank shaft (20) by measuring the position of the eccentric portion (22).

—Positioning Method for Fixed Scroll (34)—

A positioning method for the fixed scroll (34) that the positioning apparatus (40) performs will be described next.

First, a first step of the positioning method is carried out. In the first step, the assembly body (11) is placed on the mount plate (46) with the housing (36) located up. In the state that the assembly body (11) is mounted on the mount plate (46), the lower end of the body member (16) is fitted inside the guide member (51) and the lower end face of the crank shaft (20) is located above the through hole (52). In this state, the assembly body (11) is fixed to the positioning apparatus (40). Specifically, in the positioning apparatus (40), the clamp head (64) of the clamping mechanism (63) is fed towards the assembly body (11) and clamps the upper end of the body member (16) from the respective sides so as to restrict the movement of the assembly body (11). In the assembly body (11) fixed by the clamping mechanism (63), the rotary encoder (53) is connected to the lower end of the crank shaft (20) by means of the coupling (55).

Until the rotary encoder (53) is connected to the crank shaft (20), the movable scroll (31) is not mounted yet to the assembly body (11) with the eccentric portion (22) of the crank shaft (20) exposed. The inverter (81) is connected to the power supply terminal (19) of the assembly body (11) in this state. When the power is supplied to the compressor motor (25), the crank shaft (20) is driven and rotated at a given speed. The laser displacement gauge for phase measurement (not shown)

measures a distance to the eccentric portion (22) of the rotating crank shaft (20) and inputs the result to the controller (80). The controller (80) calculates a phase of the crank shaft (20) on the basis of the input from the laser displacement gauge for phase measurement and the input from the rotary encoder (53). Also, the controller (80) stores change in output torque of the compressor motor (25) in the case where the crank shaft (20) is rotated solely.

Thereafter, the movable scroll (31) is mounted to the assembly body (11) and the fixed scroll (34) is engaged with the movable scroll (31) of the assembly body (11). In detail, the fixed scroll (34) is placed on the housing (36) with the tip end of the fixed side rap (35) facing downwards so as to be in contact at the lower face thereof with the upper face of the housing (36). Accordingly, the fixed side rap (35) and the movable side rap (32), which are in the forms of volute walls, are engaged with each other. At this point, an operator inserts a provisional positioning pin into the fixed side rap (35) so that the fixed side rap (35) is positioned temporally.

Next, a second step of the positioning method is carried out. In the second step, the rod (57) of the pressing mechanism (56) is fed downwards so that the shoe (28) of the guide (41) is pressed against the upper face of the fixed scroll (34). Accordingly, the fixed scroll (34) is pressed against the housing (36) by the shoe (28) of the guide (41). Then, the operator takes out the provisional positioning pin from the fixed scroll (34).

Subsequently, a third step of the positioning method is carried out. In the third step, power is supplied to the compressor motor (25) from the inverter (81) to rotate the crank shaft (20). In association with the rotation of the crank shaft (20), the movable scroll (31) moves. At this time, the inverter (81) receives from the driver (82) an output instruction based on the output from the rotary encoder (53) and the like, so that the compressor motor (25) rotates at a given rotation speed.

During the rotation of the crank shaft (20), the controller (80) monitors change in output torque of the compressor motor (25). The controller (80) compares the monitored change in output torque with the change in output torque in the case where the crank shaft (20) is rotated solely to judge the contact position and the contacting degree between the raps (35) of the movable scroll (34) and the fixed scroll (31).

Further, on the basis of the contact position and the contacting degree between the raps (35) of the movable scroll (34) and the fixed scroll (31), the controller (80) determines a stirring distance and a stirring direction of the fixed scroll (34) which are necessary for evading contact between the raps.

After the stirring distance and the stirring direction of the fixed scroll (34) are determined, the controller (80) controls the striking units (70) according to the determined stirring direction. Specifically, the controller (80) performs control in such a manner that air is supplied to the first air chamber (104) through the first air pipe (106) and air is discharged from the second air chamber (105) through the air pipe (107) to move the main portion (71) so that the stub of the head (74) of a corresponding striking unit (70) is in contact with the fixed scroll (34). After the corresponding unit (70) is moved, the controller (80) applies pulse voltage to the piezoelectric element (73) of the corresponding striking unit (70). When the pulse voltage is applied to the piezoelectric element (73) of the corresponding striking unit (70), the piezoelectric element (73) extends according to the pulsed waveform. At this time, the inertial force of the head (74) fed accompanied by the extension of the piezoelectric element (73) works on the fixed scroll (34) to stir the fixed scroll (34) slightly. When the fixed scroll (34) is stirred, the head (74) separates from the fixed scroll (34). In order for the stub of the head (74) to be in contact with the fixed scroll (34) again, a corresponding striking unit (70) is moved. Then, pulse voltage is applied again to the piezoelectric element (73) of the corresponding striking unit (70). Whereby, the piezoelectric element (73) extends to stir the fixed scroll (34) slightly. The fixed scroll (34) being pressed against the housing (36) is gradually moved by repetition of this operation. When the stirring of the fixed scroll (34) terminates, the controller (80) performs control in such a manner that the air is supplied to the second air chamber (105) through the second air pipe (107) and air is discharged from the first air chamber (104) through the first air pipe (106) to return the corresponding striking unit (70) to the original position.

Operation of the controller (80) will be described with reference to FIG. 5. Wherein, the terms, "right," "left," "upper," and "lower" in this paragraph correspond to those in FIG. 5. For example, in order to move the fixed scroll (34) leftward, the controller (80) controls the striking unit (70) on the right side. Specifically, the controller (80) adjusts each air amount in the first air chamber (104) and the second air chamber (105) of the air cylinder section (100) to move the main portion (71) and supplies pulse voltage to the piezoelectric element (73) of the main portion (71) to apply leftward impact force to the fixed scroll (34). In contrast, in order to move the fixed scroll (34) downwards, the controller (80) controls the striking unit (70) on the upper side. As well, in order to move the fixed scroll (34) upper rightwards, the controller (80) controls the striking unit (70) on the left side, and then, controls the striking unit (70) on the lower side.

Furthermore, the controller (80) receives a stirring distance of the fixed scroll (34) which has been measured by the laser displacement gauge (65). The controller (80) selects one of the striking units (70) to be used for stirring the fixed scroll (34) on the basis of the measured stirring distance of the fixed scroll (34). Then, when the measured stirring distance of the fixed scroll (34) reaches a value necessary for evading the contact between the raps, the controller (80) judges that the stirring of the fixed scroll (34) terminates.

When the contact between the raps (35) of the movable scroll (31) and the fixed scroll (34) is evaded in the third step, the fixed scroll (34) and the housing (36) are joined with each other by means of a bolt (not shown). Thus, the fixed scroll (34) set at an appropriate position is fixed to the housing (36).

Effects of Embodiment

In the positioning apparatus (40) of the present embodiment, the fixed scroll (34) being pressed against the housing (36) is stirred by applying to it the impact force. The stirring of the fixed scroll (34) terminates with the fixed scroll (34) pressed against the housing (36). Then, the fixed scroll (34) is fixed to the housing (36) by means of a bolt in this state. Thus, the fixed scroll (34) can be fixed accurately at a position determined at positioning the fixed scroll (34). Hence, the fixed scroll (34) can be positioned with high accuracy in assembling the scroll compressor (10).

Further, the positioning apparatus (40) of the present embodiment allows the fixed scroll (34) to stir without rotating. Rotation of the fixed scroll (34) in an unintentional direction makes it difficult to accurately control the distance between the rap (35) of the fixed scroll (34) and the rap (32) of the movable scroll (31). In contrast, in the positioning apparatus (40) of the present embodiment, the guide (41) inhibits the fixed scroll (34) from rotating, resulting in accurate stirring of the fixed scroll (34) in a direction as intended. Hence, the fixed scroll (34) can be positioned with high accuracy.

In addition, in the positioning apparatus (40) of the present embodiment, the impact force in the X axis direction is applied to the fixed scroll (34) for stirring the fixed scroll (34) in the X axis direction while the impact force in the Y axis direction is applied to the fixed scroll (34) for stirring the fixed scroll (34) in the Y axis direction. Thus, the stirring distance of the fixed scroll (34) in the X axis direction is governed by the strength and the application times of the impact force in the X axis direction while the stirring distance of the fixed scroll (34) in the Y axis direction is governed by the strength and the application times of the impact force in the Y axis direction. Hence, adjustment of the strength and the application times of the impact force in the respective directions attains appropriate control of the stirring distance and the stirring direction of the fixed scroll (34), resulting in accurate positioning of the fixed scroll (34).

MODIFIED EXAMPLE 1 OF EMBODIMENT

Figure 8:
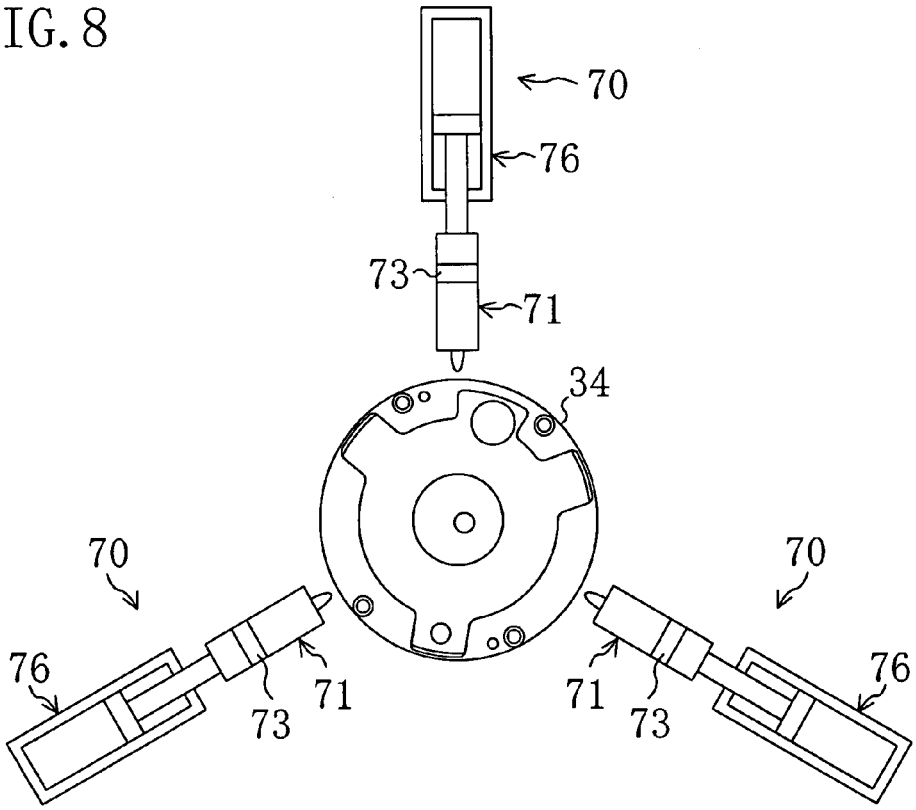
FIG. 8 is a plan view showing a main part of a positioning apparatus according to Modified Example 1 of the embodiment.

Referring to Modified Example 1 of the embodiment, difference from the above embodiment will be described. FIG. 8 is a plan view showing a main part of a positioning apparatus (40) in Modified Example 1. In Modified Example 1, the stirring mechanism (75) is composed of three striking units (70). The three striking units (75) are arranged radially at intervals of 120° with the fixed scroll (34) on the housing (36) of the assembly body (11) as a center.

The striking units (75) are reduced in number compared with that in the above embodiment, resulting in reduction in production cost of the positioning apparatus (40).

MODIFIED EXAMPLE 2 OF EMBODIMENT

Figure 9:
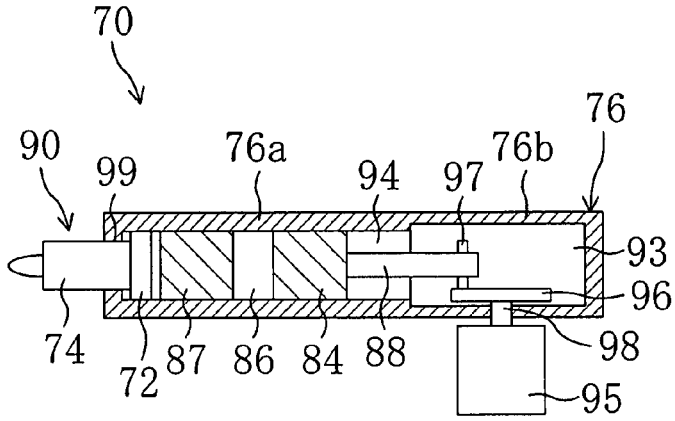
FIG. 9 is a section showing a construction of a striking unit according to Modified Example 2 of the embodiment.

Modified Example 2 of the embodiment will be described. FIG. 9 is a section showing a striking unit (70) of the stirring mechanism (75) of the positioning apparatus (40) in Modified Example 2. The striking unit (70) in Modified Example 2 is so composed to generate impact force in association with the rotation of a motor (95).

The striking unit (70) includes a casing (76) having a substantially cylindrical casing (76*a*) and a substantially cuboid casing (76*b*) which are joined to each other. A cylinder chamber (94) is formed inside the substantially cylindrical casing (76*a*) while a crank chamber (93) is formed inside the substantially cuboid casing (76*b*). The cylinder chamber (94) and the crank chamber (93) communicate with each other. A circular through hole (99) is formed at the bottom on the cylinder chamber (94) side of the casing (76). In the cylinder chamber (94), a chisel (90), a column-shaped hammer (87), and a column-shaped piston (84) are provided in this order from the through hole (99) side. The hammer (87) and the piston (84) are slidably in contact with the inner wall of the cylinder chamber (94). A compression chamber (86) is formed between the hammer (87) and the piston (84).

The chisel (90) includes a substantially column-shpaed head (74) and a disk-shaped base (72), which are formed integrally and coaxially with each other. The head (74) has a stub at the tip end (that is, on a side opposite the base (72)). The head (74) is inserted through the through hole (99) and extends outwards from the casing (76). The base (72) is slidably in contact with the inner wall of the cylinder chamber (94). The radius of the base (72) is larger than the radius of the through hole (99). The base (72) prevents the chisel (90) from falling off from the casing (76).

In the crank chamber (93), a crank (96) is provided which engages with the motor (95) outside the casing (76) through a crank shaft (98). The crank (96) includes a crank pin (97) for holding a connecting stick (88) connected to the bottom on the crank chamber (93) side of the piston (84). The crank (96), the crank pin (97), and the connecting stick (88) change the rotation of the motor (95) into reciprocating motion of the piston (84).

When the motor (95) drives to rotate the crank (96), the piston (84) is in the reciprocating motion. The reciprocating motion of the piston (84) contracts and expands air in the compression chamber (86) to cause the hammer (87) to be in reciprocating motion. When the hammer (87) moves towards the chisel (90), the hammer (87) collides with the base (72) of the chisel (90). The collision of the chisel (90) moves the head (74) towards the tip end side thereof to cause the stub of the head (74) to collide with the fixed scroll (34). Thus, impact force is applied from the head (74) to the fixed scroll (34).

The striking unit (70) in Modified Example 2 has no air cylinder section (101), which is the difference from the above embodiment. The striking unit (70) is provided so that the stub of the head (74) is out of contact with the fixed scroll (34) at the time when the chisel (90) retreats inside the casing (76) and so that the stub of the head (74) reaches the fixed scroll (34) at the time when the chisel (90) moves towards the tip end side of the head (74) thereof.

Other Embodiments

Figure 10:
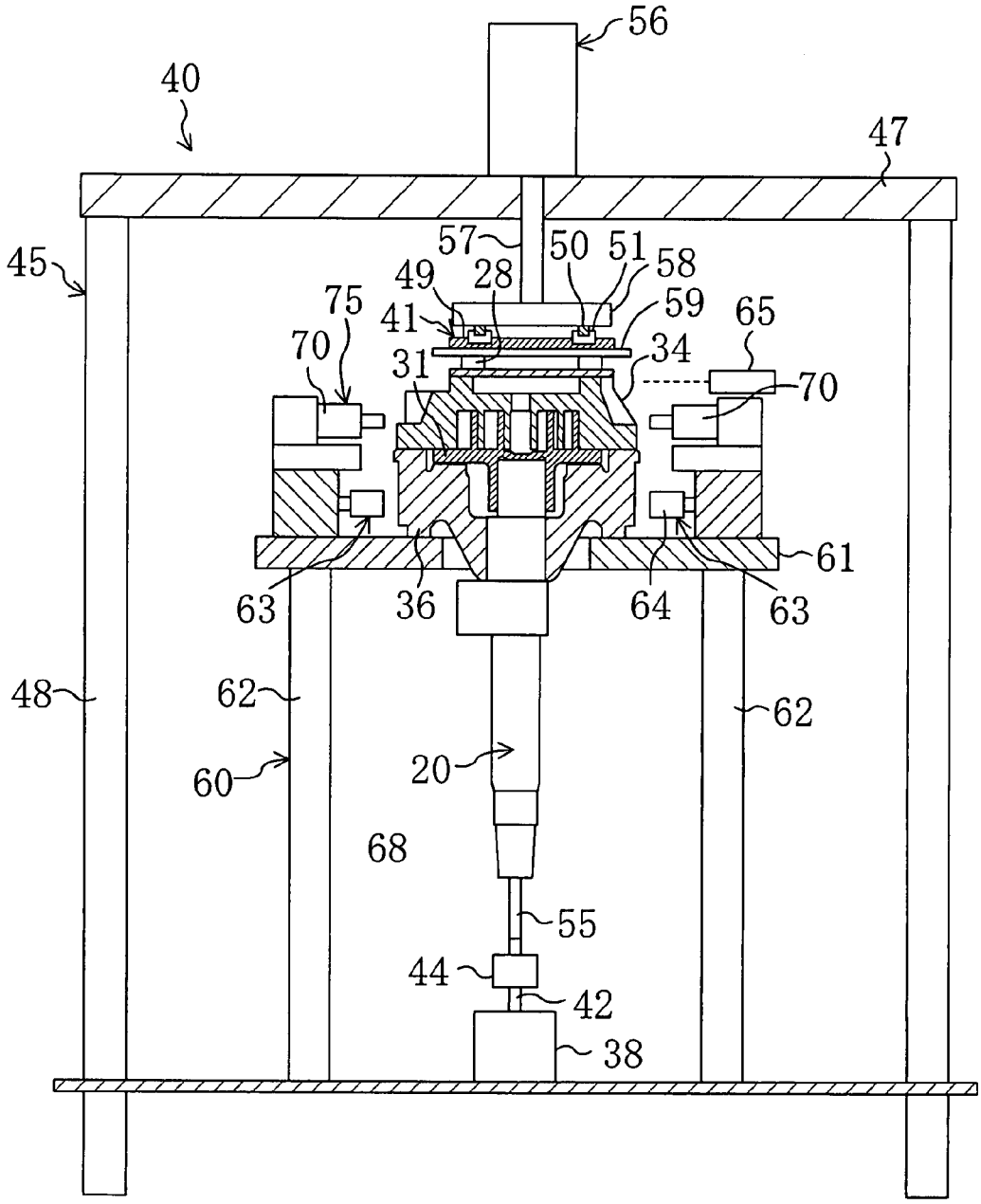
FIG. 10 is a front view showing a schematic construction of a positioning apparatus according to another embodiment.

An assembly body (11) as an integrated combination of only the housing (36), the crank shaft (20), and the movable scroll (31) may be fixed to the positioning apparatus (40) in the above embodiment. The positioning apparatus (40) in this case is shown in the front view of FIG. 10. The assembly body (11) is placed on the frame member (61) fixed at the tip ends of the pole members (62) and is clamped and fixed at the outer peripheral face of the housing (36) by the clamp head (64) of the clamping mechanism (63). The clamping mechanism (63) is provided on the frame member (61).

In this positioning apparatus (40), the through hole (52) is not formed in the mount plate (46) and a servo motor (38) is placed on the mount plate (46). The servo motor (38) has a rotary shaft (42) extending upwards and passing through a torque detecting tool (44) for detecting torque necessary for rotating the crank shaft (20). A coupling (55) is mounted at the tip end of the rotary shaft (42) so as to extend upward coaxially with the rotary shaft (42). The tip end of the coupling (55) is detachably fitted to the lower end of the crank shaft (20) of the scroll compressor (10).

The positioning apparatus (40) in this case is provided with a controller (80) composing determining means for determining a stirring distance and a stirring direction of the fixed scroll (34) on the basis of detected values of the servo motor (38) and the torque detecting tool (44). Further, the controller (80) controls the striking units (70) composing the stirring mechanism (75) so that the fixed scroll (34) is stirred to a position determined by the determining means.

It is noted that the above embodiments are preferred examples of the present invention and is not intended to limit the scopes of the present invention, applicable objects, and applicable usages.

INDUSTRIAL APPLICABILITY

As described above, the present invention is useful in methods and apparatuses for positioning the fixed scroll (34) in assembling scroll fluid machineries.

The invention claimed is:

1. An apparatus, for use in an assembling process of a scroll fluid machinery, for positioning a fixed scroll on the basis of a positional relationship between a rap of the fixed scroll and a rap of a movable scroll, the apparatus, comprising:

a fixing member for fixing an assembly body of an integrated combination of the movable scroll, a crank shaft engaged with the movable scroll, and a housing member composing a bearing of the crank shaft;

a pressing mechanism for pressing the fixed scroll engaged with the movable scroll against the housing member;

a determining unit configured to determine a stirring distance and a stirring direction of the fixed scroll;

a stirring mechanism for stirring the fixed scroll according to the stirring distance and the stirring direction which are determined by the determining unit by applying impact force to the fixed scroll being pressed against the housing member; and a guide, provided in the pressing mechanism, for inhibiting the fixed scroll from rotating while allowing the fixed scroll to stir in parallel to an X axis direction or a Y axis direction which intersect at a right angle with each other, wherein the X axis direction and the Y axis direction in which the guide allows the fixed scroll to stir agree with directions of the impact force that the pressing mechanism applies to the fixed scroll.

2. The fixed scroll positioning apparatus of claim 1, wherein the determining unit determines the stirring distance and the stirring direction of the fixed scroll so that the rap of the fixed scroll is out of contact with the rap of the movable scroll regardless of the position of the movable scroll.

3. The fixed scroll positioning apparatus of claim 1, wherein the stirring mechanism includes a plurality of striking units for applying the impact force to the fixed scroll by striking, and in the stirring mechanism, the striking units are different from each other in striking direction.

4. The fixed scroll positioning apparatus of claim 1, wherein the stirring mechanism includes four striking units for applying impact force to the fixed scroll by striking, and two of the four striking units confront each other on an axis parallel to the X axis while the other two striking units confront each other on an axis parallel to the Y axis.

5. The fixed scroll positioning apparatus of claim 3 or 4, wherein the striking units includes a piezoelectric element and applies striking by extending the piezoelectric element.

6. A method for positioning a fixed scroll, in a process of assembling a scroll fluid machinery, on the basis of a positional relationship between a rap of the fixed scroll and a rap of a movable scroll, the method comprising:

a first step of fixing an assembly body of an integrated combination of the movable scroll, a crank shaft engaged with the movable scroll, and a housing member composing a bearing of the crank shaft and engaging the fixed scroll with the movable scroll;

a second step of pressing a guide for inhibiting the fixed scroll from rotating while allowing the fixed scroll to stir in parallel to an X axis direction or a Y axis direction which intersect at a right angle with each other against the fixed scroll engaged with the movable scroll in the first step, and pressing the fixed scroll against the housing member; and a third step of adjusting the position of the fixed scroll by stirring by applying impact force to the fixed scroll being pressed against the housing member.

* * * * *